US010765906B2

(12) United States Patent
Nieberding, III

(10) Patent No.: US 10,765,906 B2
(45) Date of Patent: Sep. 8, 2020

(54) WEIGHT COLLAR

(71) Applicant: Frederick A. Nieberding, III, Marysville, KS (US)

(72) Inventor: Frederick A. Nieberding, III, Marysville, KS (US)

( * ) Notice: Subject to any disclaimer, the term of this patent is extended or adjusted under 35 U.S.C. 154(b) by 0 days.

(21) Appl. No.: 15/877,641

(22) Filed: Jan. 23, 2018

(65) Prior Publication Data

US 2018/0339183 A1 Nov. 29, 2018

Related U.S. Application Data

(60) Provisional application No. 62/511,507, filed on May 26, 2017, provisional application No. 62/449,732, filed on Jan. 24, 2017.

(51) Int. Cl.

| | |
|---|---|
| ***A63B 21/072*** | (2006.01) |
| ***A63B 21/075*** | (2006.01) |
| ***A63B 21/06*** | (2006.01) |
| ***A63B 21/02*** | (2006.01) |

(52) U.S. Cl.

CPC ..... *A63B 21/0728* (2013.01); *A63B 21/075* (2013.01); *A63B 21/026* (2013.01); *A63B 21/0602* (2013.01); *A63B 21/0603* (2013.01); *A63B 21/0724* (2013.01); *A63B 2209/00* (2013.01)

(58) Field of Classification Search

CPC ..... A63B 21/0728; A63B 21/075; A63B 21/0724; A63B 2209/00; A63B 21/0603; A63B 21/0602; A63B 21/026

USPC ..... 16/66

See application file for complete search history.

(56) References Cited

U.S. PATENT DOCUMENTS 2,051,969 A * 8/1936 Shastock ..... F16B 2/246 403/105
2,617,363 A * 11/1952 Anketell ..... B61B 12/127 104/202
2,732,920 A * 1/1956 Newton ..... G03B 21/18 16/48.5
3,162,889 A * 12/1964 Runnels ..... E05F 3/00 16/66
4,817,944 A * 4/1989 Anderson ..... A63B 21/0728 24/129 D
5,108,066 A * 4/1992 Lundstrom ..... A63B 21/0728 24/524
5,295,933 A * 3/1994 Ciminski ..... A63B 21/0728 24/270

(Continued)

*Primary Examiner* — Andrew S Lo

(74) *Attorney, Agent, or Firm* — Hovey Williams LLP

(57) ABSTRACT

A weight collar for retaining a weight on a bar, comprising a bar engaging section having an opening for receiving the bar therethrough and a weight engaging section having proximal and distal ends, the weight engaging section extending from the bar engaging section so as to extend at least partially toward the weight when the bar engaging section receives the bar through the opening, the bar engaging section being configured to engage the bar with a gripping force as the weight exerts a rotational force on the distal end of the weight engaging section so as to prevent the weight from sliding off the bar, the distal end of the weight engaging section being orthogonally spaced at least 1 inch from a central axis of the opening, a center of gravity of the collar being orthogonally spaced at least 0.1 inches from the central axis toward the distal end.

11 Claims, 3 Drawing Sheets

(56) References Cited

U.S. PATENT DOCUMENTS

| | | | | | |
|---|---|---|---|---|---|
| 5,845,360 | A * | 12/1998 | Lantzy | E05F 3/108 | 16/84 |
| 6,032,331 | A * | 3/2000 | Alonso | E05C 17/30 | 16/49 |
| D425,776 | S * | 5/2000 | Alonso | D8/343 | |
| 6,179,514 | B1 * | 1/2001 | Cheng | B25G 3/10 | 285/308 |
| 6,663,060 | B1 * | 12/2003 | Gifford, Sr. | F16B 7/14 | 248/125.8 |
| 6,976,288 | B1 * | 12/2005 | Luca | E05C 17/30 | 16/2.1 |
| 7,086,631 | B2 * | 8/2006 | Lee | F16M 11/26 | 248/161 |
| 7,111,359 | B1 * | 9/2006 | Luca | E05C 17/30 | 16/66 |
| 8,142,335 | B1 * | 3/2012 | Leach | A63B 21/0728 | 482/107 |
| 2005/0155179 | A1 * | 7/2005 | Duffy | E05C 17/30 | 16/66 |
| 2010/0005715 | A1 * | 1/2010 | Allsop | A01G 9/12 | 47/47 |
| 2011/0224053 | A1 * | 9/2011 | Hamilton | A63B 21/0728 | 482/107 |
| 2013/0072359 | A1 * | 3/2013 | Leach | A63B 71/0036 | 482/107 |
| 2016/0310782 | A1 * | 10/2016 | Slaughter | A63B 21/0728 | |
| 2016/0375295 | A1 * | 12/2016 | Brasch | A63B 21/0728 | 482/107 |

* cited by examiner

WEIGHT COLLAR

RELATED APPLICATIONS

This regular utility non-provisional patent application claims priority benefit with regard to all common subject matter of earlier-filed U.S. Provisional Patent Application titled "WEIGHT COLLAR", Ser. No. 62/449,732, filed on Jan. 24, 2017, and earlier-filed U.S. Provisional Patent Application titled "WEIGHT COLLAR", Ser. No. 62/511,507, filed on May 26, 2017. The above-identified provisional patent applications are hereby incorporated by reference in their entireties into the present application.

BACKGROUND

Weight collars are often used for retaining weights on weightlifting bars. However, most conventional weight collars must be secured to the weightlifting bar. Unfortunately, weightlifters often fail to fully secure the weight collars, which can result in dangerous conditions for the weightlifters themselves, spotters, and nearby weightlifters. Many conventional weight collars can also incorrectly appear to be properly secured, resulting in a false sense of safety. Furthermore, conventional weight collars have moving parts and/or rubber components that can wear out over time or over repeated use. The parts often fail during use when their integrity is needed most.

SUMMARY

Embodiments of the invention solve the above-mentioned problems and provide a distinct advance in weight collars for use with weightlifting systems, counterweight systems, ballast systems, and any other system in which a weight needs to be retained on a weight bearing structure. More specifically, the invention provides a more reliable and easy-to-use weight collar.

An embodiment of the weight collar broadly comprises a bar engaging section and a weight engaging section. The bar engaging section includes an opening and an annular surface. The opening extends through the bar engaging section for positioning the weight collar on a weight section of a weightlifting bar. The opening may be circular or any other suitable shape.

The annular surface extends along an outer perimeter of the opening and is concentric about a central axis passing through a centerpoint of the opening. In one embodiment, the central axis extends perpendicular to a vertically extending plane of the bar engaging section. In another embodiment, the central axis extends at a non-perpendicular angle relative to the vertically extending plane, the purpose of which will be described in more detail below.

The weight engaging section includes opposing proximal and distal ends. The distal end is orthogonally spaced from the central axis an offset distance of between approximately 1 inch and approximately 8 inches, more preferably between approximately 1.5 inches and approximately 5 inches, and most preferably between approximately 2 inches and approximately 4 inches. The distal end is axially spaced forward of the centerpoint of the opening an axial distance of between approximately 3 inches and approximately 1 inch, more preferably between approximately 2 inches and approximately 2.5 inches, and most preferably approximately 2.25 inches. In one embodiment, the weight engaging section is angled from the bar engaging section at an angle between approximately 90 degrees and approximately 135 degrees, more preferably between approximately 100 degrees and approximately 130 degrees, and most preferably 112 degrees.

A center of gravity of the weight collar may be orthogonally spaced an offset distance from the central axis between approximately 0.1 inches and approximately 1.5 inches, more preferably between approximately 0.5 inches and approximately 1 inch, and most preferably 0.5 inches. In one embodiment, the center of gravity is orthogonally spaced outside of the perimeter of the opening.

A ratio of the offset distance of the distal end to the offset distance of the center of gravity is between approximately 1.1 to 1 and approximately 10 to 1, more preferably between approximately 1.5 to 1 and approximately 4 to 1, and most preferably between approximately 2 to 1 and approximately 3 to 1. In another embodiment, the ratio of the offset distance of the distal end to the offset distance of the center of gravity is greater than 1 to 1.

The weight collar may by anodized, painted, coated, or otherwise surface treated for protecting the weight collar and/or other components of a weight system and for providing an appealing appearance. The weight collar may also be laser engraved, etched, stamped, or painted with logos, aesthetic designs, instructions, warnings, and other text or images.

In use, the weight collar may be positioned on the weight lifting bar between the weight and a distal end of the weightlifting bar such that the weightlifting bar passes through the opening of the bar engaging section and such that the distal end of the weight engaging section extends toward the weight. The center of gravity of the weight collar is orthogonally offset from the central axis of the opening, as described above, so that the weight collar will rotate about the central axis until the weight engaging section hangs below the weightlifting bar.

As the weightlifting bar is handled and lifted, the weight may shift and slide relative to the weightlifting bar. If the weight slides toward the weight collar, the weight will exert a rotational force on the distal end of the weight engaging section of the weight collar. The bar engaging section in turn imparts a gripping force on the weightlifting bar via the annular surface, thus preventing the weight from sliding off the weightlifting bar. The offset distance of the distal end of the weight engaging section from the central axis of the opening of the bar engaging section increases a moment arm of the weight collar, thus improving the effectiveness of the rotational force.

It is also important that the weight collar does not slide away from the weight particularly when the weight is not engaging the weight collar. To that end, the weight engaging section, extending forward from the bar engaging section, causes the center of gravity of the weight collar to be slightly forward of the opening. The weight collar thus rotates slightly under its own gravitational weight such that the bar engaging section exerts a nominal gripping force on the weightlifting bar.

In some embodiments, the central axis of the opening extends through the centerpoint non-perpendicular to the vertically extending plane of the bar engaging section such that the annular surface causes the bar engaging section to extend downward at a forward angle when positioned on the weightlifting bar. This causes the center of gravity to be farther forward of the opening, which increases rotation of the weight collar via its gravitational weight and thus increases the nominal gripping force. The non-perpendicular central axis also causes the bar engaging section to be oriented vertically when the weightlifting bar is pointed upward at an angle complementary to the non-perpendicular angle of the central axis such that the weight collar slides on the weightlifting bar toward the weight.

The weight collar provides other benefits in addition to the ones described above. For example, the weight collar has no moving parts and is self-locking. In contrast, conventional weight collars can be positioned on a weightlifting bar but may not necessarily be locked, resulting in a false sense of safety. The weight collar also will not wear out over time or over repeated use.

Another embodiment of the weight collar further comprises a spring for ensuring that the weight collar is retained on the weightlifting bar. The spring includes opposing base and distal ends and is connected at its base end near the distal end of the weight engaging section via fasteners, welding, interlocking geometry, interference fit, or any other suitable attachment means. The distal end of the spring may pass in front of the opening so that the spring must be at least partially depressed or compressed for the weight collar to be positioned on a weightlifting bar. In one embodiment, the spring extends in a cantilever arc away from the weight engaging section and toward the opening of the bar engaging section so that the spring can be depressed via the weightlifting bar as the weight collar is being pushed onto the weightlifting bar. The spring may be a leaf spring, coil spring, butterfly spring, torsion spring, or any other suitable spring.

The spring exerts a biasing force against the weightlifting bar such that the bar engaging section imparts a nominal gripping force on the weightlifting bar when the weight is not engaging the weight engaging section. This prevents the weight collar from sliding freely relative to the weightlifting bar.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
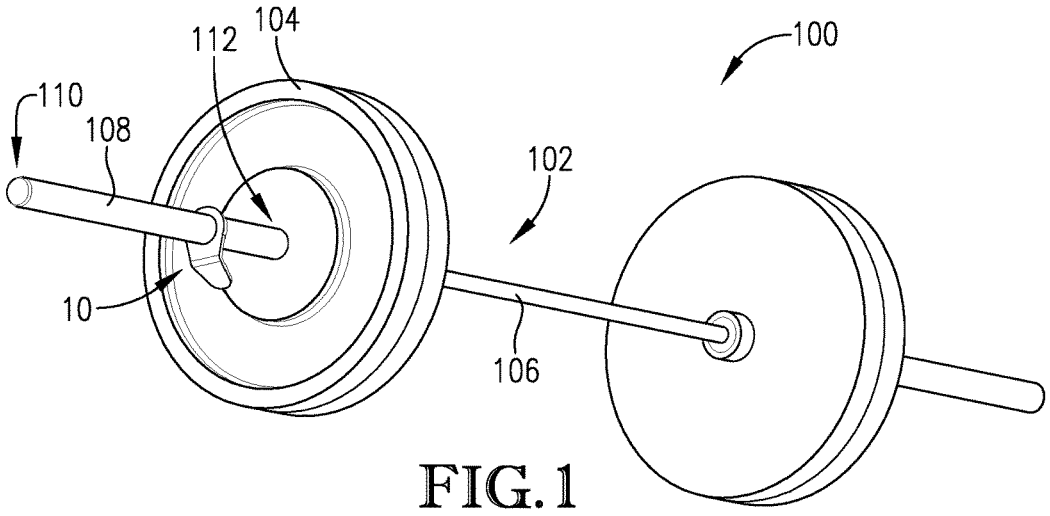
FIG. 1 is a perspective view of a weight system including a weight collar constructed in accordance with an embodiment of the invention.
Figure 2:
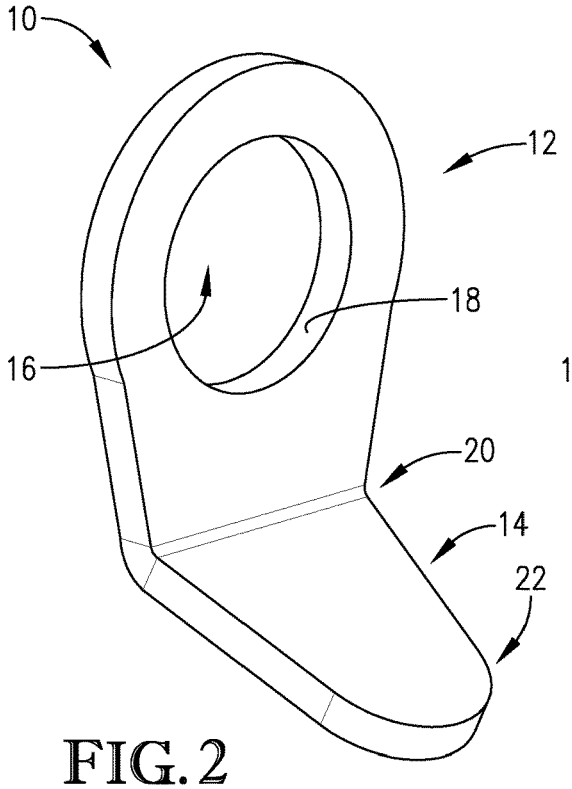
FIG. 2 is a perspective view of the weight collar of FIG. 1.
Figure 3:
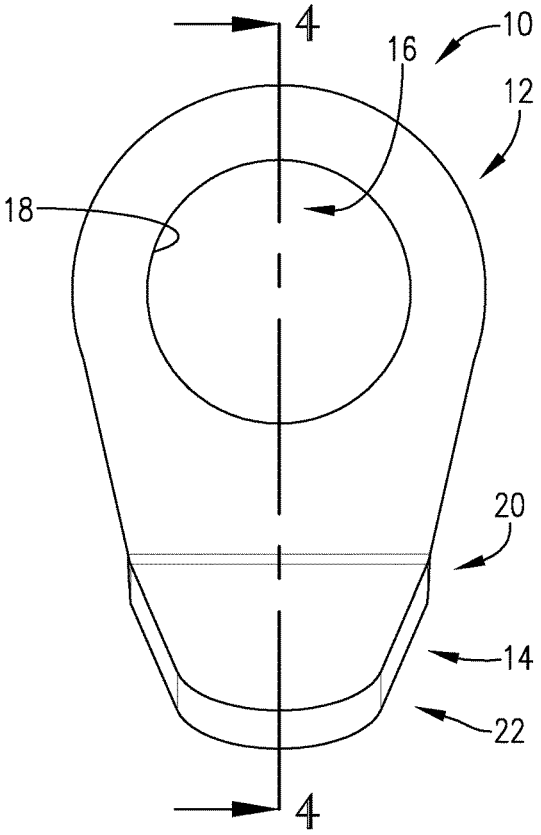
FIG. 3 is a front elevation view of the weight collar of FIG. 1.
Figure 4:
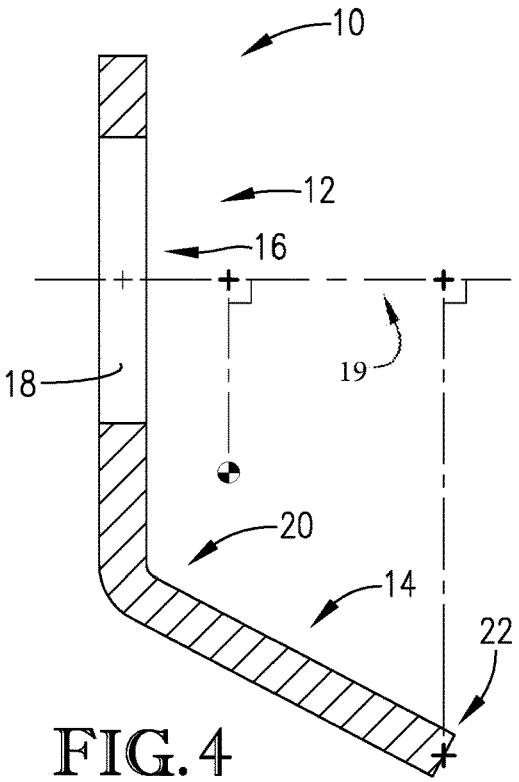
FIG. 4 is a side cutaway elevation view of the weight collar of FIG. 1.
Figure 5:
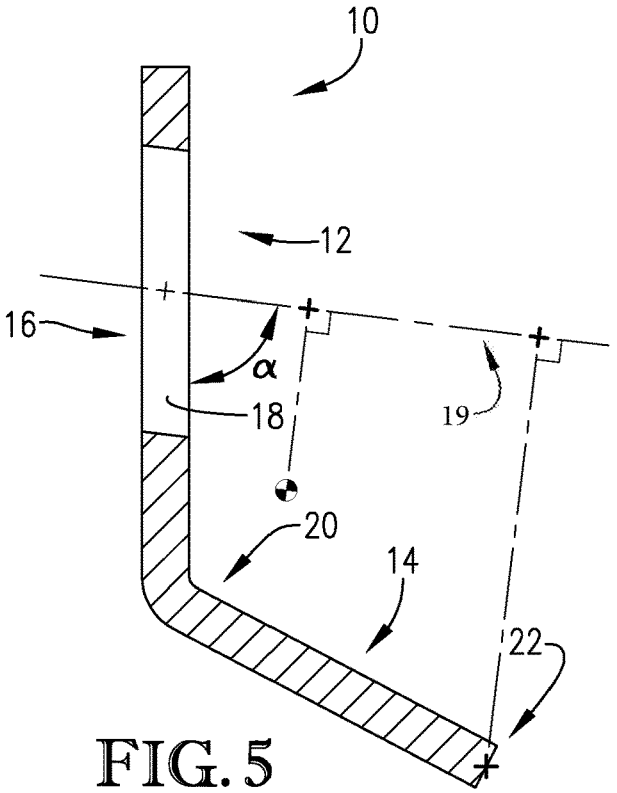
FIG. 5 is a side cutaway elevation view of a weight collar constructed in accordance with another embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to FIGS. 1-5, a weight collar 10 constructed in accordance with an embodiment of the invention is illustrated. The weight collar 10 can be part of and/or used with a weight system 100 having a weightlifting bar 102 and a weight 104. The weightlifting bar 102 includes a lifting section 106 and a weight section 108. The lifting section 106 allows a user to grip and lift the weightlifting bar 102 and may include contours, bends, rough surface textures, handles, grip pads, hand stops, and other features for improving the user's grip. The weight section 108 extends from the lifting section 106 and includes a weight stop and a distal end 110. The weight stop prevents the weight 104 from sliding onto the lifting section 106 and may be an axially-aligned disc or ring, a clip, a pin extending through the weightlifting bar 102, or any other suitable stop. Alternatively, the lifting section 106 may have a diameter larger than a diameter of a through-hole of the weight 104 (described below) for preventing the weight 104 from sliding onto the lifting section 106. The distal end 110 allows a user to position the weight 104 and weight collar 10 on and remove the weight 104 and weight collar 10 from the weight section 108 of the weightlifting bar 102. The weight section 108 may have a circular cross section, a rectangular cross section, or any other suitable cross section.

The weight 104 includes a through-hole 112 for positioning the weight 104 on the weight section 108 and may be a disc, plate, ball, or any other suitable mass. To that end, a diameter of the through-hole 112 is slightly larger than a diameter of the weight section 108 and smaller than an effective diameter of the weight stop or lifting section 106. The weight 104 may be adjustable (e.g., fillable with water or sand) or non-adjustable such as a barbell weight plate. Additional weights similar to weight 104 may be used to achieve a desired total weight.

The weight system 100 may be a barbell system, a dumbbell system, a weightlifting machine (in which case the lifting section 106 is indirectly lifted by the user), or any other suitable weight system. For example, the weight system 100 may be part of a counterweight or ballast system.

The weight collar 10 will now be described in more detail. The weight collar 10 includes a bar engaging section 12 and a weight engaging section 14.

The bar engaging section 12 includes an opening 16 and an annular surface 18. The opening 16 extends through the bar engaging section 12 for positioning the weight collar 10 on the weight section 108. The opening 16 may be circular or any other suitable shape (similar to the cross-sectional shape of the weight section 108) and may have a diameter slightly larger than a diameter of the weight section 108. In one embodiment, the opening 16 has a diameter of between approximately 0.5 inches and approximately 3 inches, more preferably between approximately 1 inch and 2.5 inches, and most preferably approximately 2 inches.

The annular surface 18 extends along an outer perimeter of the opening 16 and may be concentric about a central axis 19 passing through a centerpoint of the opening 16. In one embodiment, the central axis 19 extends perpendicular to a vertically extending plane of the bar engaging section 12. In another embodiment, the central axis 19 extends relative to the vertically extending plane at an angle (a in FIG. 5) of between approximately 70 degree and approximately 89 degrees, more preferably between approximately 80 degree and 89 degrees, and most preferably 83 degrees, the purpose of which will be described in more detail below.

The weight engaging section 14 includes opposing proximal and distal ends 20, 22. The proximal end 20 may be spaced from an outer edge of the opening 16 of the bar engaging section 12 preferably at least 0.8 inches. The distal end 22 may be orthogonally spaced from the central axis 19 an offset distance of between approximately 1 inch and approximately 8 inches, more preferably between approximately 1.5 inches and approximately 5 inches, and most preferably between approximately 2 inches and approximately 4 inches. The distal end 22 may be axially spaced forward of the centerpoint an axial distance of between approximately 3 inches and approximately 1 inch, more preferably between approximately 2 inches and 2.5 inches, and most preferably approximately 2.25 inches. The weight engaging section 14 may be angled from the bar engaging section 12 at an angle between approximately 90 degrees and approximately 135 degrees, more preferably between approximately 100 degrees and approximately 130 degrees, and most preferably 112 degrees.

A center of gravity (represented by the center of gravity symbol in FIGS. 4 and 5) of the weight collar 10 may be orthogonally spaced from the central axis 19 an offset distance of between approximately 0.1 inches and approximately 1.5 inches, more preferably between approximately 0.5 inches and approximately 1 inch, and most preferably 0.5 inches. In one embodiment, the center of gravity is orthogonally spaced outside of the perimeter of the opening 16. The center of gravity may be axially spaced from the centerpoint an axial distance of between approximately 0.1 inches and approximately 2 inches, more preferably between approximately 0.5 inches and 1.5 inches, and most preferably approximately 1 inch.

A ratio of the offset distance of the distal end 22 to the offset distance of the center of gravity may be between approximately 1.1 to 1 and approximately 10 to 1, more preferably between approximately 1.5 to 1 and approximately 4 to 1, and most preferably between approximately 2 to 1 and approximately 3 to 1. In another embodiment, the ratio of the offset distance of the distal end 22 to the offset distance of the center of gravity is greater than 1 to 1. A ratio of the axial distance of the distal end 22 to the axial distance of the center of gravity may be between approximately 1.1 to 1 and approximately 10 to 1, more preferably between approximately 1.5 to 1 and approximately 3 to 1, and most preferably at least 2 to 1.

The bar engaging section 12 and the weight engaging section 14 may be connected together near the proximal end 20 of the weight engaging section 14 or they may be formed of a monolithic piece of material. For example, the weight collar 10 may be cut or stamped from a metal plate and bent at the proximal end 20 of the weight engaging section 14. To that end, the metal plate, and hence the bar engaging section 12 and the weight engaging section 14 may have a thickness of between approximately 0.125 inches and approximately 0.375 inches and more preferably approximately 0.25 inches. The weight collar 10 may have an overall length of between approximately 1 inch and approximately 6 inches, more preferably between approximately 2 inches and 6 inches, and most preferably approximately 5.75 inches. The weight collar 10 may have a tapered width that narrows from the centerpoint of the opening 16 to the distal end 22 of the weight engaging section. The weight collar 10 may also have rounded edges so that it does not catch on clothing, gym bags, other weight equipment, and other hazards, and so that it does not scratch weight equipment, floors, and skin.

The weight collar 10 may by anodized, painted, coated, or otherwise surface treated for protecting the weight collar 10 and/or other components of the weight system 100 and for providing an appealing appearance. The weight collar 10 may also be laser engraved, etched, stamped, or painted with logos, aesthetic designs, instructions, warnings, and other text or images.

Use of the weight collar 10 with the weight system 100 will now be described in more detail. First, the weight 104 is positioned on the weightlifting bar 102 such that the weight section 108 passes through the through-hole 112 of the weight 104 and such that the distal end 110 of the weight section 108 extends beyond the weight 104. To that end, it is recommended that the weight 104 be pushed against the weight stop. Additional weights can also be positioned on the weight section 108 adjacent the weight 104. The weight collar 10 may then be positioned on the weight lifting bar 102 between the weight 104 and the distal end 110 of the weight section 108 such that the weight section 108 passes through the opening 16 of the bar engaging section 12 and such that the distal end 22 of the weight engaging section 14 extends toward the weight 104. The center of gravity of the weight collar 10 is orthogonally offset from the central axis 19 of the opening 16, as described above, so the weight collar 10 will rotate about the central axis 19 until the weight engaging section 14 hangs below the weight section 108. It is also recommended that the weight collar 10 be pushed against the weight 104 so that the distal end 22 of the weight engaging section 14 contacts the weight 104.

As the weightlifting bar 102 is handled and lifted, the weight 104 may shift and slide relative to the weight section 108. If the weight 104 slides toward the distal end 110 of the weight section 108, and hence toward the weight collar 10, the weight 104 will exert a rotational force on the distal end 22 of the weight engaging section 22 of the weight collar 10. The bar engaging section 12 in turn imparts a gripping force on the weight section 108 of the weightlifting bar 102 via the annular surface 18, thus preventing the weight 104 from sliding off the distal end 110 of the weight section 108. The offset distance of the distal end 22 of the weight engaging section 14 from the central axis 19 of the opening 16 of the bar engaging section 14 increases a moment arm of the weight collar 10, thus improving the effectiveness of the rotational force.

It is also important that the weight collar 10 does not slide away from the weight 104 particularly when the weight 104 is not engaging the weight collar 10. To that end, the weight engaging section 14, extending forward from the bar engaging section 12, causes the center of gravity of the weight collar 10 to be slightly axially forward of the centerpoint of the opening 16. The weight collar 10 thus rotates slightly under its own gravitational weight such that the bar engaging section 12 exerts a nominal gripping force on the weight section 108.

In some embodiments, as described above, the central axis 19 of the opening 16 extends non-perpendicularly through the bar engaging section 12 such that the annular surface 18 causes the bar engaging section 12 to extend downward at a forward angle. This causes the center of gravity to be farther forward of the opening 16, which increases rotation via gravitational weight and thus increases the nominal gripping force. The non-perpendicular angle of the central axis 19 also causes the bar engaging section 12 to be oriented vertically when the weightlifting bar 102 is pointed upward at an angle complementary to the non-perpendicular angle such that the weight collar 10 slides on the weight section 108 toward the weight 104. For example, in one embodiment, the central axis 19 extends through the centerpoint of the opening 16 at 83 degrees relative to the vertically extending plane of the bar engaging section 12. Thus, if the weightlifting bar 100 is pointed upward at 7 degrees, the bar engaging section 12 will be oriented vertically, allowing the weight collar 10 to slide toward the weight 104.

The weight collar 10 provides other benefits in addition to the ones described above. For example, the weight collar 10 has no moving parts and is self-locking. In contrast, other weight collars can be positioned on a weightlifting bar but may not necessarily be locked, resulting in a false sense of safety. The weight collar 10 also will not wear out over time or over repeated use.

Figure 6:
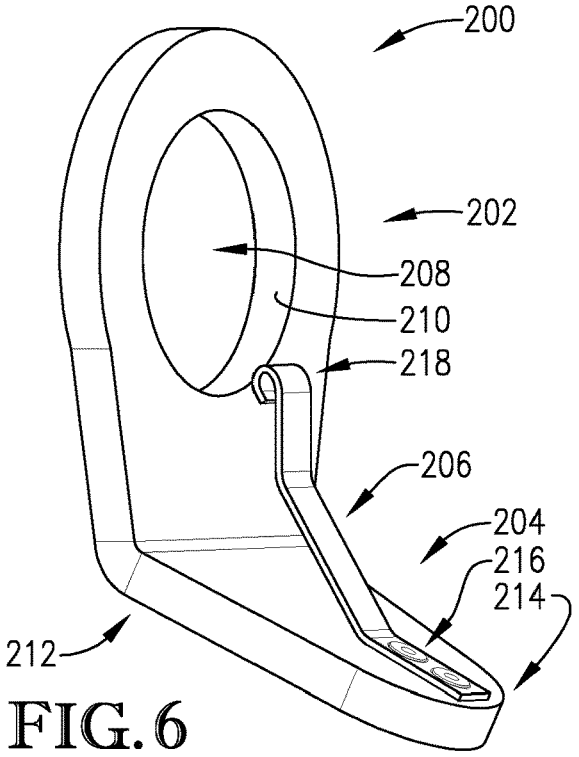
FIG. 6 is a perspective view of a weight collar constructed in accordance with another embodiment of the invention.
Figure 7:
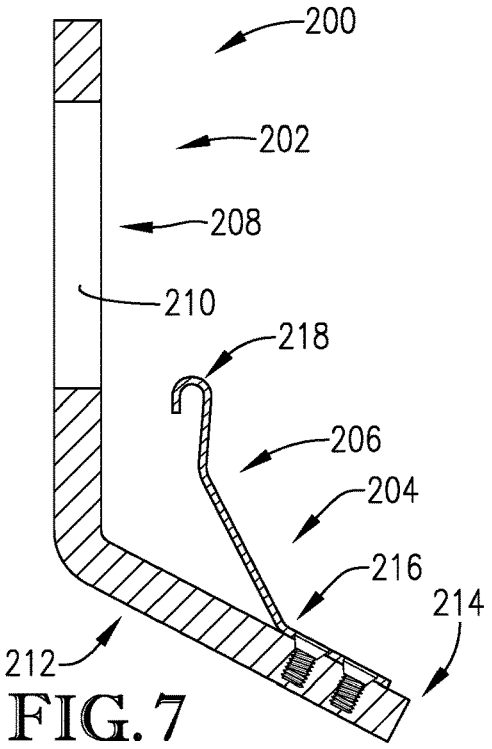
FIG. 7 is a perspective view of the weight collar of FIG. 6.

Turning to FIGS. 6 and 7, a weight collar 200 constructed in accordance with another embodiment of the invention will now be described. The weight collar 200 includes a bar engaging section 202, a weight engaging section 204, and a spring 206. The bar engaging section 202 and weight engaging section 204 are substantially similar to the bar engaging section 12 and weight engaging section 14 described above. For example, the bar engaging section 202 includes an opening 208 and an annular surface 210 substantially similar to the opening 16 and annular surface 18 described above. The weight engaging section 204 includes opposing proximal and distal ends 212, 214 substantially similar to the proximal and distal ends 20, 22 described above. These features will therefore not be described further.

The spring 206 includes opposing base and distal ends 216, 218 and is connected at the base end 216 near the distal end 214 of the weight engaging section 214 via fasteners, welding, interlocking geometry, interference fit, or any other suitable attachment means. The distal end 218 of the spring 206 may pass in front of the opening 208 so that the spring 206 must be at least partially depressed or compressed for the weight collar 200 to be positioned on a weightlifting bar. In one embodiment, the spring 206 extends in a cantilever arc away from the weight engaging section 204 and toward the opening 208 of the bar engaging section 202 so that the spring 206 can be depressed via the weightlifting bar as the weight collar 200 is being pushed onto the weightlifting bar. The distal end 218 of the spring 206 may be turned or rolled inward so that it does not catch on or scratch weight lifting equipment. The spring 206 may be a leaf spring, coil spring, butterfly spring, torsion spring, or any other suitable spring.

The spring 206 exerts a biasing force against the weightlifting bar such that the bar engaging section 202 imparts a nominal gripping force on the weightlifting bar when a weight is not engaging the weight engaging section 204. This prevents the weight collar 200 from sliding freely relative to the weightlifting bar.

Figure 8:
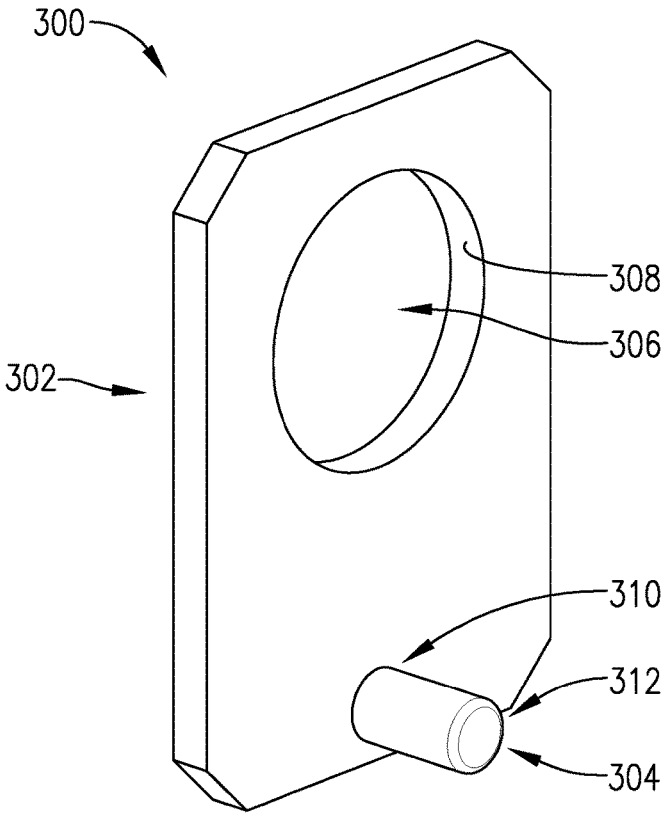
FIG. 8 is a perspective view of a weight collar constructed in accordance with another embodiment of the invention.
Figure 9:
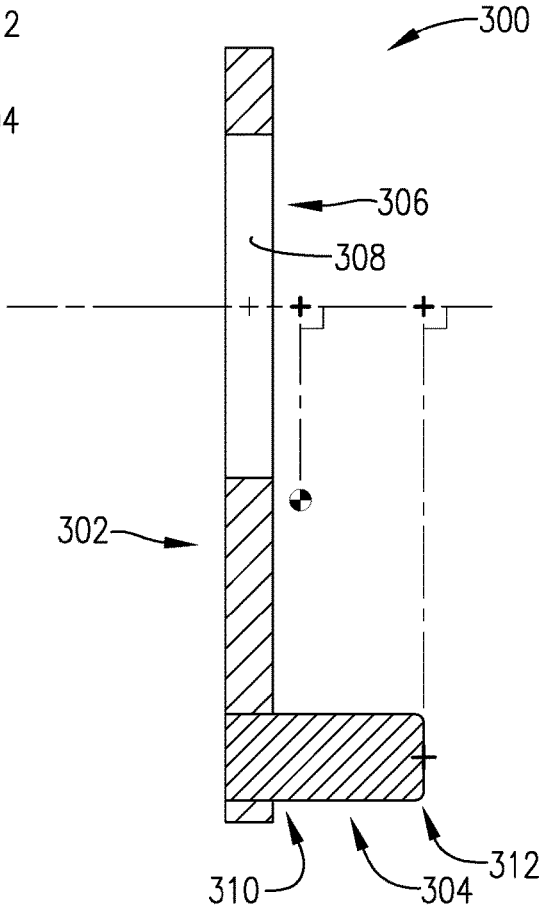
FIG. 9 is a side cutaway elevation view of the weight collar of FIG. 8.

Turning to FIGS. 8 and 9, a weight collar 300 constructed in accordance with another embodiment will now be described. The weight collar 300 includes a bar engaging section 302 and a weight engaging component 304. The bar engaging section 302 is substantially similar to the bar engaging section 12 described above. For example, the bar engaging section 302 includes an opening 306 and an annular surface 308 substantially similar to the opening 16 and annular surface 18 described above. These features will therefore not be described further.

The weight engaging component 304 includes opposing proximal and distal ends 310, 312 and extends substantially perpendicular to a vertically extending plane of the bar engaging component 302. The weight engaging component 304 may be secured into an opening in the bar engaging section 12 via helical threads, an interference fit, interlocking geometry, or any other suitable attachment means. The weight engaging component 304 may be orthogonally offset from the center axis between approximately 1 inch and approximately 8 inches, more preferably between approximately 1.5 inches and approximately 5 inches, and most preferably between 2 inches and approximately 4 inches. The weight engaging component 304 may extend axially forward of a centerpoint of the opening 306 between approximately 0.25 inches and approximately 3 inches, more preferably between approximately 0.5 inches and 2 inches, and most preferably approximately 0.75 inches. The weight engaging component 304 may be a pin, bolt, nub, or other similar protrusion.

A center of gravity of the weight collar 300 may be orthogonally spaced from the central axis an offset distance of between approximately 0.1 inches and approximately 1.5 inches, more preferably between approximately 0.5 inches and approximately 1 inch, and most preferably 0.5 inches. In one embodiment, the center of gravity is orthogonally spaced outside of the perimeter of the opening 306. The center of gravity may be axially spaced from the centerpoint of the opening 306 an axial distance of between approximately 0.1 inches and approximately 2 inches, more preferably between approximately 0.5 inches and 1.5 inches, and most preferably approximately 1 inch.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A collar for retaining a weight on a bar, the collar comprising:

a bar engaging section having an opening for receiving the bar therethrough and an annular surface encircling the opening, the annular surface being concentric about a central axis of the opening;

a weight engaging section having opposing proximal and distal ends, the weight engaging section extending from the bar engaging section near the proximal end so as to extend at least partially toward the weight when the bar engaging section receives the bar through the opening, the bar engaging section being configured to engage the bar with a gripping force as the weight exerts a rotational force on the distal end of the weight engaging section so as to prevent the weight from sliding off the bar, the distal end of the weight engaging section being orthogonally spaced from the central axis of the opening an offset distance of at least 1 inch, a center of gravity of the collar being orthogonally spaced from the central axis toward the distal end an offset distance of at least 0.1 inches; and a leaf spring connected to the weight engaging section and extending in a cantilever arc toward the opening of the bar engaging section such that the leaf spring can be depressed via the bar as the collar is being pushed onto the bar, the leaf spring being configured to exert a biasing force against the bar such that the bar engaging section imparts a nominal gripping force on the bar when the weight is not engaging the weight engaging section for preventing the collar from sliding freely relative to the bar.

2. The collar of claim 1, wherein a ratio of the offset distance of the distal end to the offset distance of the center of gravity is greater than approximately 1:1.

3. The collar of claim 1, wherein a ratio of the offset distance of the distal end to the offset distance of the center of gravity is between approximately 1.1:1 and approximately 10:1.

4. The collar of claim 1, wherein the offset distance of the distal end is between approximately 1.5 inches and approximately 5 inches and the offset distance of the center of gravity is greater than approximately 0.5 inches.

5. The collar of claim 1, wherein the opening has a diameter of approximately 2 inches and the offset distance of the center of gravity is greater than approximately 1 inch.

6. The collar of claim 1, wherein the weight engaging section is angled from the bar engaging section, the proximal end of the weight engaging section being spaced from an outer edge of the opening by at least 0.8 inches.

7. The collar of claim 1, wherein the weight engaging section is angled from the bar engaging section between approximately 90 degrees and approximately 135 degrees.

8. The collar of claim 1, wherein the bar engaging section and the weight engaging section are formed of a monolithic piece of material.

9. The collar of claim 8, wherein the weight engaging section is angled from the bar engaging section via a bend in the material.

10. The collar of claim 1, wherein the spring must be at least partially depressed for the collar to be positioned on the bar.

11. The collar of claim 1, wherein the weight engaging section tapers in width from the proximal end to the distal end.

* * * * *